United States Patent [19]

Hoerner

[11] Patent Number: 4,890,652

[45] Date of Patent: Jan. 2, 1990

[54] TRASH BAG SUPPORT SLEEVE

[76] Inventor: L. Jeanne Hoerner, 1247 Emerald Way, Visalia, Calif. 93277

[21] Appl. No.: 29,616

[22] Filed: Mar. 23, 1987

[51] Int. Cl.[4] ..... B65B 5/12

[52] U.S. Cl. ..... 141/10; 141/114; 141/316; 141/390; 141/391; 15/257.1; 53/390; 248/99

[58] Field of Search ..... 141/10, 68, 114, 313–317, 141/390, 391, 392, 98; 229/132; 15/257.1; 53/390; 248/97–101

[56] References Cited

U.S. PATENT DOCUMENTS

| | | | |
|---|---|---|---|
| 576,782 | 2/1897 | Goodrich | 141/390 |
| 672,657 | 4/1901 | Vautrot | 141/390 |
| 1,139,281 | 5/1915 | Hazelton | 383/119 |
| 2,216,299 | 10/1940 | Schilling | 229/132 X |
| 3,822,524 | 7/1974 | Jerpbak | 141/390 |
| 3,915,329 | 10/1975 | Zaks | 141/390 |
| 4,037,778 | 7/1977 | Boyle | 383/111 |
| 4,268,081 | 5/1981 | Hawkinson | 15/257.1 X |
| 4,338,979 | 7/1982 | Dow | 141/10 |
| 4,457,483 | 7/1984 | Gagne | 248/97 |
| 4,509,570 | 4/1985 | Eby et al. | 141/390 |
| 4,530,533 | 7/1985 | Dieter | 248/99 X |
| 4,620,681 | 11/1986 | Staley et al. | 248/95 |
| 4,628,007 | 12/1986 | Ledsham | 428/542.8 |
| 4,749,011 | 6/1988 | Rylander | 141/316 |

*Primary Examiner*—Ernest G. Cusick

*Attorney, Agent, or Firm*—Baker, Maxham, Jester & Meador

[57] ABSTRACT

An elongated sleeve made of a plurality of substantially rigid panels interconnected with one another in folding relationship. When in the stored condition, the sleeve is folded flat. When in condition to be used for its intended purpose, the sleeve is unfolded to form an open ended sleeve closed on the sides. The sleeve is adapted to positively retain and support a collapsible bag at the top while the bag is being filled by filling the interior of the sleeve. Handles are provided in the top edges of the sleeve to facilitate removal of the sleeve from the full bag.

16 Claims, 1 Drawing Sheet

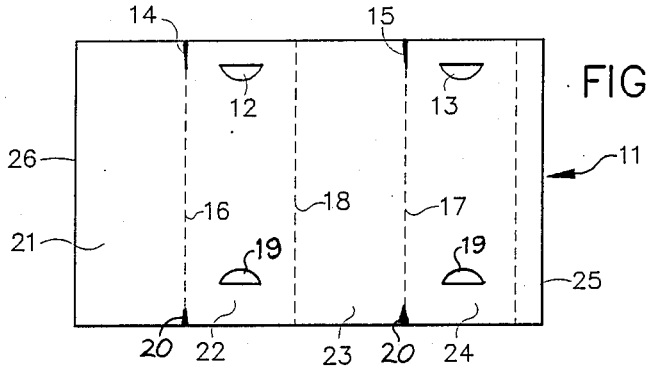
FIG. 1
FIG. 2
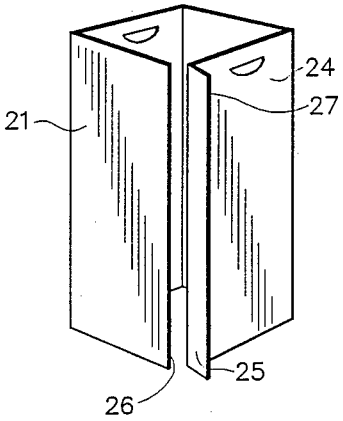
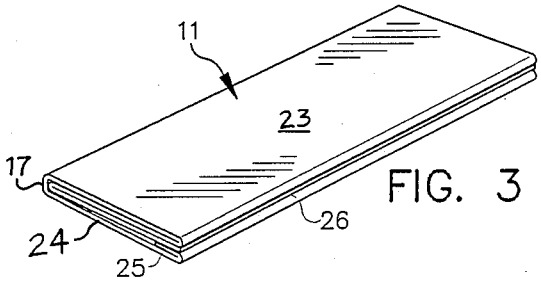
FIG. 3
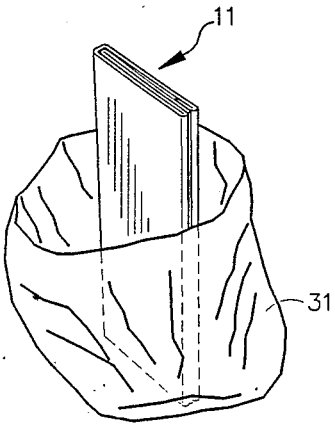
FIG. 4
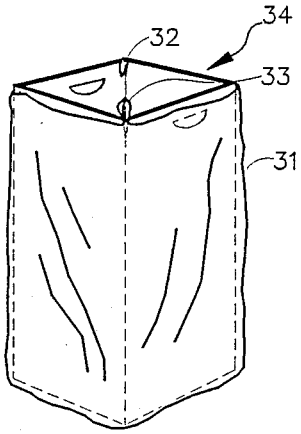
FIG. 5
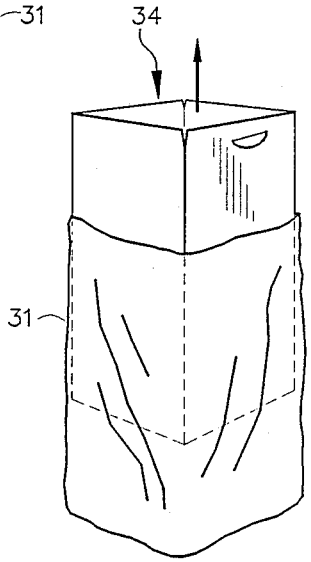
FIG. 6

TRASH BAG SUPPORT SLEEVE

FIELD OF THE INVENTION

This invention relates generally to devices for supporting trash bags during the filling process, and more particularly concerns a smooth-sided relatively rigid sleeve made of a plurality of side panel members adapted to reside within the bag during the filling process and to be easily removed therefrom when the bag is full.

BACKGROUND OF THE INVENTION

Filling plastic bags with debris, while a simple process, is often quite vexing in that the bag tends to collapse and the open upper end very often folds in upon itself just at the moment when something bulky needs to be inserted. Another problem is that when relatively multi-faceted, elongated or angular items such as portions of rose bushes or tree branches are inserted, it is very easy to tear the bag.

This problem has been recognized in the past and several attempts have been made to rectify it. U.S. Pat. No. 4,037,778 shows a plurality of elongated rigid panels some of which are interconnected in a folding relationship, where the open sided structure that is formed tends to open outwardly to frictionally hold the sides of the plastic bag to prevent the bag from collapsing. When the bag is full, the liner is removed from inside the bag. U.S. Pat. No. 4,628,007 shows a circular insert having a similar purpose and functioning in a similar way, that is, it is not a closed structure and it frictionally engages the side walls of the bag by opening outwardly against them.

Generally, the prior art devices do not have closed sides nor a means for positively holding the top open edge of the bag in appropriate relationship with the top of the sleeve.

SUMMARY OF THE INVENTION

The structure of the present invention provides means for maintaining a collapsible bag in fully open condition and for positively retaining the top open edges of the bag during the filling process. Those edges are easily released from the top of the sleeve and the sleeve easily removed from the bag after it has been filled.

The sleeve of this invention is comprised of several interconnected panels which are adapted to fold upon each other to form a flat, rectangular structure in the stored condition. All of the panels are interconnected to form an enclosed sleeve when it is opened to its operative condition whereby just the ends are opened allowing trash to be put into one end and come out through the other end when the sleeve is lifted out of the bag.

The positive bag retaining aspect comprises one or more narrow slits at the corners of the sleeve, each of which positively retains a small portion of the bag material. Any force that would tend to pull the bag downwardly would serve to further enhance the firmness with which the bag is held in those slots. Additionally, hand holes are provided to facilitate lifting the sleeve out of the bag after the filling process is complete.

BRIEF DESCRIPTION OF THE DRAWING

The objects advantages and features of this invention will be more readily perceived from the following detailed description when read in conjunction with the accompanying drawing, in which:

FIG. 1 shows in plan view the interconnected panel blank of this invention in the open, flat, non-joined condition;

FIG. 2 is a perspective view depicting the blank of FIG. 1 ready for final assembly by joining the opposite long edges;

FIG. 3 is a perspective view of the sleeve of the invention in the flat condition for storing and shipping;

FIG. 4 is a perspective view of the invention of FIG. 3 placed in a collapsible bag ready for opening to form the sleeve structure;

FIG. 5 is a perspective view showing the sleeve of the invention in operative condition within a collapsible bag with the top edges of the bag secured to the sleeve slits; and FIG. 6 is a perspective view depicting the sleeve of the invention being removed from the collapsible bag after the bag has been filled.

DETAILED DESCRIPTION OF THE PREFERRED EMBODIMENT

As shown in FIG. 1, the sleeve of the invention may be comprised of a rectangular blank 11 formed of substantially rigid material which is lightweight and of appropriate thickness. The material from which this blank is made is contemplated to be a cardboard or pasteboard but it could be made of any material which satisfies the stated requirements. It may be reusable or disposable and its surface may be untreated or it may be coated with wax, plastic or other substance to make it waterproof, longer lasting or more slippery, for example. Further, the blank may be made in a variety of sizes to fit various sizes of collapsible trash bags. Typically, these bags are thought of as plastic bags and that term will be used herein in the generic sense.

The blank is formed with hand-hold cut-outs 12 and 13 which would typically be cut on the arc and folded along the straight line. This would protect the user's hands when lifting the sleeve out of the filled bag. Slits 14 and 15 are formed at the ends of two creases 16 and 17 between adjacent panels at that location. The slits are relatively narrow and may have parallel sides or be wedge shaped to readily receive a portion of the plastic bag. Preferably slits 14 and 15 are two to three inches long, or approximately 10–15% of the length of the panels.

Panel 21 is at one end of the rectangular blank, panels 22 and 23 are the middle panels, panel 24 is at the opposite end and a narrow tab 25 extends from the outside edge of panel 24.

As shown in FIG. 2, when the panels are folded at creases 16, 17 and 18, with tab 25 adjacent and under the free edge 26 of panel 21, a closed rectangle is formed. Adhesive may be applied to what may be termed the outside surface 27 of tab 25 and the tab is folded inside free edge 26 of panel 21 and secured thereto, thereby forming the closed rectangular sleeve. Alternatively, the tab may be secured to panel 21 by other means such as stapling or riveting, among others.

Note that the sleeve in its final form for use need not be rectangular but could be made of any number of panels, preferably at least four.

At least one fold line such as fold line 17 between panels 23 and 24 must be sufficiently wide to permit the double wide folding required for the flat, stored condition shown in FIG. 3. Some of the panels fold closely on each other while panels 23 and 24 as shown in FIG. 3 must have the wider fold line so that the panels can lie flat. It is contemplated that the product in the flat condition shown in FIG. 3 for storage and transportation would be packaged by shrink wrapping or a stretch wrapping in accordance with current known methods, with appropriate labeling on the product and possibly on the packaging itself.

When ready for use, the wrapping is removed and the product, still in the flattened condition, is inserted into plastic bag 31 as shown in FIG. 4. The product is then opened up as shown in FIG. 5 to form sleeve 34, occupying substantially the entire interior of the plastic bag. The user then pulls a small portion 32, 33 of the top edge of the bag inward through each of slits 14 and 15, thus positively anchoring the top of the bag to the sleeve and preventing any possible slippage due to gravity. If desired, similar slits can be formed in all four corners for even more positive anchoring of the top of the bag.

The user can then fill the bag with whatever items are to be disposed of, such as lawn clippings, shrub cuttings, leaves and other trash. The waste material can be firmly compressed down into sleeve 34 as it is being filled, thus allowing a substantially larger volume of material to be stored than would otherwise be possible without the use of a sleeve.

It should now be apparent that the sleeve not only supports the bag in an upright filling condition but guards the sides of the bag against punctures and tears from thorns or other sharp, ragged materials and also guides the filling process by virtue of the rigid support system which it provides.

When the level of material being stored has risen to within a few inches of the top of sleeve 34, the user withdraws bag elements 32 and 33 from the anchoring slits, the user's fingers are inserted between the bag and the outside of the sleeve in hand-hold cut-outs 12 and 13 and with a gentle shaking motion, sleeve 34 is easily removed from the interior of bag 31. The weight of the contents has the gravitational effect of keeping the contents in the bag and keeping the bag on the ground while the lightweight, empty sleeve is being removed. The filled bag is then ready to be tied and disposed of.

While the sleeve as shown in the drawing comprises a top and a bottom where the top includes the hand-hold cut-outs and the slits, blank 11 of FIG. 1 could easily be formed with cut-outs 19 and slits 20 in both opposite edges. Thus there would be no top or bottom, thereby making the sleeve of the invention even easier to use since it need not be oriented with respect to the bag.

In view of the above description, it is likely that modifications and improvements will occur to those skilled in the art which are within the scope of the appended claims. For example, tab 25 could be replaced by other closure means such as hook and loop strips.

What is claimed is:

1. A sleeve for supporting and protecting the inside surface of a collapsible bag during the process of filling the bag, said sleeve comprising:

four similarly shaped substantially, continuously rigid elongated panels connected together to form an elongated area of connection between each adjacent two said panels and to form a unitary closed square cross-sectional structure about an axis and having an open top and an open bottom with respective top and bottom edges, said elongated area of connection between each adjacent two said panels being a connection line; and at least one top narrow slit formed in said top edge of said structure and extending a relatively short distance toward the opposite edge thereof;

said slit being adapted to receive a portion of the material at the open end of the bag in a secure wedging relationship to thereby positively retain the bag in upright supported condition around said structure;

said square structure adapted for being generally the same length from said top edge to said bottom edge as the length of the bag, thereby providing coextensive, full length protection of the inside bag wall from damage when material is forced into it, and positively self supporting the bag in an upright condition;

said panels being mutually foldable at said connection line between each two adjacent panels so that said structure may be folded to a flat condition, one panel in width, for storage and shipping.

2. The sleeve recited in claim 1, and further comprising a second top narrow slit on the opposite side of said top edge from said at least one narrow slit.

3. The sleeve recited in claim 2, and further comprising a plurality of top narrow slits arranged in spaced relationship around said top edge of said structure.

4. The sleeve recited in claim 1, and further comprising a pair of hand-hold cut-outs in two opposite ones of said panels adjacent and spaced from said top edge of said structure.

5. The sleeve recited in claim 1, and further comprising:

at least one bottom narrow slit formed in said bottom edge of said structure;

whereby said sleeve may be inserted into the bag without regard to axial orientation.

6. The sleeve recited in claim 5, and further comprising a pair of hand-hold cut-outs in two opposite ones of said panels adjacent and spaced from said top and bottom edges of said structure.

7. The sleeve recited in claim 6, and further comprising a second top narrow slit on the opposite side of said top edge from said at least one narrow slit.

8. The sleeve recited in claim 7, and further comprising a plurality of top narrow slits arranged in spaced relationship around the top edge of said structure.

9. The sleeve recited in claim 5, and further comprising a second bottom narrow slit formed in said bottom edge of said structure.

10. A sleeve for supporting and protecting the inside surface of a collapsible bag during the process of filling the bag, said sleeve comprising:

a first substantially, continuously rigid elongated panel having a free long edge;

a second substantially rigid elongated panel of substantially the same length as said first panel, said first and second panels being so interconnected along their common long edges as to permit them to be folded together in face-to-face confronting relationship;

a third substantially rigid elongated panel of substantially the same length as said first panel, said third panel being so connected to said second panel along their common long edges as to permit them to be folded together in face-to-face confronting relationship;

a fourth substantially rigid elongated panel of substantially the same length as said first panel, said fourth panel having a free long edge, said fourth panel being so connected to said third panel along their common long edges as to permit them to be folded together in face-to-face confronting relationship, all of said panels being similar in shape; and means for connecting said free long edges of said first and fourth panels together to form a unitary substantially closed sleeve adapted to be of generally the same length as the bag for coextensive full length protection thereof, said sleeve having a square cross section, said connecting means permitting said first and fourth panels to be folded together in face-to-face confronting relationship and permitting said sleeve to be folded to a flat condition with all said panels in mutually confronting parallel relationship for shipping and storage, the folded condition of said sleeve being one panel in width;

the adjacent long edge of at least two interconnecting panels having a relief area extending from one end a relatively short distance toward the opposite end thereby forming a first narrow slit at the interconnection between two adjacent said panels adjacent at least one end of said sleeve;

said slit being adapted to receive a portion of the material at the open end of the bag in a secure wedging relationship to thereby positively retain the bag in upright self supported condition around said sleeve.

11. The sleeve recited in claim 10, and further comprising a second narrow slit formed at the interconnection between two adjacent said panels on the opposite side of said one end of said sleeve.

12. The sleeve recited in claim 11, and further comprising a plurality of narrow slits arranged in spaced relationship around said one end of said sleeve.

13. The sleeve recited in claim 10, and further comprising a pair of hand-hold cut-outs in two opposite ones of said panels adjacent and spaced from said one end of said sleeve.

14. The sleeve recited in claim 10, wherein said closed rectangular sleeve has a substantially square configuration when viewed from either end thereof, said square configuration facilitating folding the sleeve to the flat condition.

15. A method for retaining upright and filling a collapsible refuse bag with an enhanced amount of debris, some of which may be irregularly shaped, without causing damage to the bag walls, said method comprising the steps of:

inserting into the bag an open ended, unitary, four-similar-shaped-paneled, closed sided sleeve in a flat, closed condition with all four panels being in mutually parallel confronting relationship, said sleeve being generally coextensive in length with the bag, the outer circumference of said sleeve being substantially similar to and less than the inner circumference of the bag, the top edge of said sleeve being formed with at least one narrow slit therein extending toward the bottom open end for a relatively short distance;

opening said sleeve by unfolding it to form a square cross section to generally expand the bag walls and spread them into a fully open condition;

bringing the open end of the bag up around said sleeve so that the edge of the open end of the bag is adjacent the top open end of said sleeve, the bottom open end of said sleeve being against the closed bottom of the bag;

pulling a gathered fractional portion of the top edge of the bag tightly into said at least one slit, whereby said sleeve self supports the bag in an open condition and positively holds the bag upright due to the engagement of said bag portion with said at least one slit; then stuffing refuse of any description into said sleeve that can be fit therein;

disengaging said bag portion from said at least one slit; and then withdrawing said sleeve from the bag, leaving the refuse within the bag.

16. A method for effectively temporarily making a fixed sided box out of a collapsible refuse bag to enable it to be filled with an enhanced amount of debris, some of which may be irregularly shaped, without causing damage to the bag walls, said method comprising the steps of:

inserting into the bag an open ended, unitary, four-similar-shaped-paneled, closed sided sleeve in a closed, flat condition with all four panels being in mutually parallel confronting relationship, said sleeve being generally coextensive with the bag, the outer circumference of said sleeve being substantially similar to and less than the inner circumference of the bag, the top edge of said sleeve being formed with at least one narrow slit therein extending toward the bottom open end for a relatively short distance;

opening said sleeve by unfolding it to form a square cross section to generally expand the bag walls and spread them into a fully open condition;

bringing the open end of the bag up around said sleeve so that the edge of the open end of the bag is adjacent the top open end of said sleeve, the bottom open end of said sleeve being against the closed bottom of the bag;

pulling a gathered fractional portion of the top edge of the bag tightly into said at least one slit, whereby said sleeve self supports the bag in an open condition and positively holds the bag upright due to the engagement of said bag portion with said at least one slit; then stuffing refuse of any description into said sleeve that can be fit therein;

disengaging said bag portion from said at least one slit; and then withdrawing said sleeve from the bag, leaving the refuse within the bag.

* * * * *